United States Patent [19]

Kiuchi et al.

[11] 4,147,910

[45] Apr. 3, 1979

[54] POWER ADJUSTMENT WITH VARIABLE FREQUENCY AND DUTY-CYCLE CONTROL FOR INDUCTION HEATING APPARATUS

[75] Inventors: Mitsuyuki Kiuchi; Takumi Mizukawa; Keizo Amagami; Hirokazu Yoshida, all of Kadoma, Japan

[73] Assignee: Matsushita Electric Industrial Co., Ltd., Japan

[21] Appl. No.: 803,968

[22] Filed: Jun. 6, 1977

[30] Foreign Application Priority Data

Jun. 4, 1976 [JP] Japan ..... 51/65900

[51] Int. Cl.[2] ..... H05B 5/04

[52] U.S. Cl. ..... 219/10.49 R; 219/10.77; 323/24; 363/165

[58] Field of Search ..... 219/10.49, 10.75, 10.77; 323/24; 307/265, 271; 363/78, 10, 159, 160, 162, 165, 161

[56] References Cited

U.S. PATENT DOCUMENTS

| | | | |
|---|---|---|---|
| 3,436,642 | 4/1969 | Segsworth | 363/78 |
| 3,633,094 | 1/1972 | Clements | 323/24 |
| 3,781,505 | 12/1973 | Steigerwald | 219/10.77 |
| 3,925,633 | 12/1975 | Partridge | 219/10.77 |
| 3,930,193 | 12/1975 | Kornrumpf et al. | 219/10.77 |
| 3,946,322 | 3/1976 | Katz | 307/265 |
| 4,074,101 | 2/1978 | Kiuchi et al. | 219/10.77 |

*Primary Examiner*—Bruce A. Reynolds

*Attorney, Agent, or Firm*—Burns, Robert E.; Emmanuel J. Lobato; Bruce L. Adams

[57] ABSTRACT

In an induction heating cooking apparatus, the frequency of electromagnetic energy is varied in response to a desired power setting level within an allowable range and the duty cycle of the energy is varied in response to the setting level while the frequency is set at the lower limit of the allowable range. The combined effects of frequency and duty cycle controls permit the power to vary from as low as 50 watts to as high as 2 kilowatts.

5 Claims, 6 Drawing Figures

POWER ADJUSTMENT WITH VARIABLE FREQUENCY AND DUTY-CYCLE CONTROL FOR INDUCTION HEATING APPARATUS

FIELD OF THE INVENTION

The present invention relates generally to induction heating cooking apparatus and in particular to such apparatus capable of providing a wider range of power control. This invention is particularly suitable for simmering cooking operations.

BACKGROUND OF THE INVENTION

The amount of heat generated in an inductively coupled cooking vessel is conventionally controlled by varying the frequency of electromagnetic energy or by means of periodic interruption of the electromagnetic energy. However, the controllable range of frequencies is restricted by the upper frequency limit set by the operating characteristic of thyristor switching devices and by the lower frequency limit set by the acoustic sensitivity of the human ears. Therefore, the available power control range is not wide enough to meet a variety of cooking operations. The periodic interruption of the electromagnetic energy, on the other hand, introduces periodic change in voltage of the mains supply if the period of interruption is longer than an appreciable length of time, which could result in flickering of the indoor lighting level when the induction heating apparatus is energized by current supplied from a common source.

SUMMARY OF THE INVENTION

The primary object of the invention is to extend the power control range of an induction heating cooking apparatus to meet a wide variety of cooking needs.

Another object of the invention is to extend the power control range to such a lower level that the apparatus can be used for cooking operations in which foodstuff is simmered or stewed gently for an extended period of time at relatively low temperatures.

A further object of the invention is to provide an induction heating cooking apparatus which permits a wide range of power control without causing an appreciable degree of drops in source voltage.

These objects are achieved by the induction heating cooking apparatus of the invention which combines the effects of frequency variation and periodic interruption of electromagnetic energy in response to a desired power setting level. In accordance with the invention, frequency control operation is limited to a range from a lower limit corresponding to the upper audible frequency limit of the human ears to an upper limit set by the operating characteristic of thyristor switching devices. Below the lower frequency limit power control is switched to periodic interruption so that while the frequency is set to the lower limit the energy is interrupted for periodic intervals, the length of which correspond to the desired power level. Therefore, the power interruption control covers a lower range from 50 watts to 0.5 kilowatts and the frequency control covers an upper range from 0.5 to 2.0 kilowatts.

The periodic interruption of high frequency oscillations might accompany a loss of power if the oscillation generating thyristors are fired subsequently when the excitation voltage is high, resulting in a surge current which dissipates as a loss of energy.

Still another object of the invention is provide periodic interruption of energy without loss of usable energy by re-firing the thyristors in synchronism with a detected zero crossover point of the source voltage subsequent to each interruption of energy.

Since cooking vessels are varied in size to meet specific cooking needs and the heat generated therein should be controlled to a desired setting regardless of the size of the vessel, the invention further contemplates to compare the power actually delivered to the vessel with the setting level nd modulate the oscillation frequency in accordance with the amount of deviation from the setting level in a feedback control operation. This provides an advantage in that once a desired power level is set, the feedback control permits the oscillation frequency to be adjusted to a new value when the inductive load is suddenly changed by replacement with another vessel of different size.

BRIEF DESCRIPTION OF THE DRAWINGS

These and other objects, features and advantages will become apparent from the following description taken in conjunction with the accompanying drawings, in which.

DESCRIPTION OF THE PREFERRED EMBODIMENTS

Figure 1:
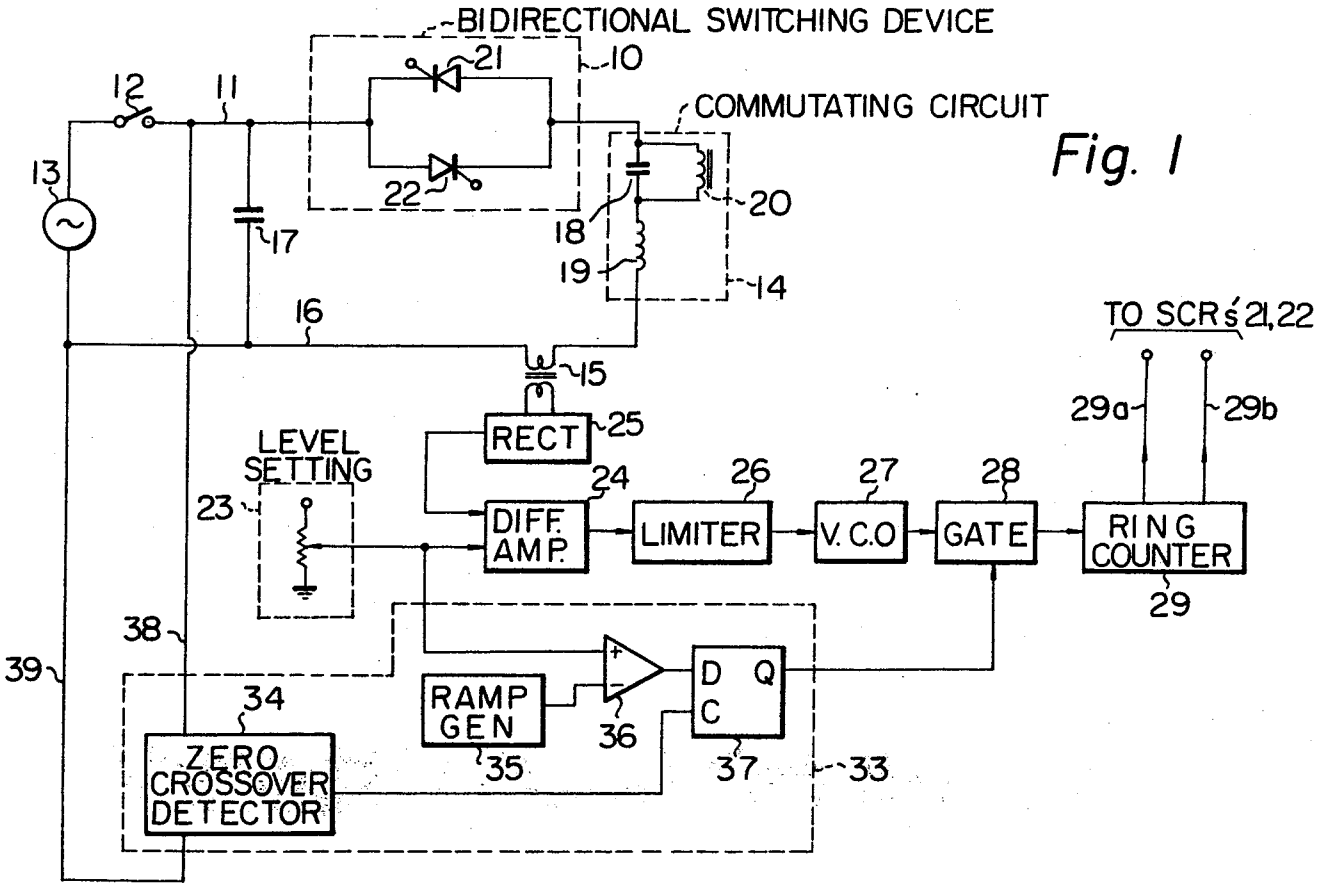
FIG. 1 is a schematic illustration of an embodiment of the invention.

Referring now to FIG. 1 of the drawings, an induction heating cooking apparatus embodying the present invention is illustrated. A bidirectional switching device 10 is coupled through lead 11 and switch 12 to one terminal of a source of low frequency alternating voltage available from such as commercial or residential 100 volts 60 Hz voltage source 13. The other end of the switching device 10 is connected through a commutating circuit 14 and the primary winding of a current transformer 15 to the other terminal of the voltage source 13 over lead 16. Between leads 11 and 16 is connected a capacitor 17 for passing oscillating currents generated in a manner described below.

The bidirectional switching device 10 comprises a pair of inversely parallel connected thyristors 21 and 22 with their control electrodes connected to a gating circuit to be described below. The commutating circuit 14 is comprised of series connected commutating capacitor 18 in parallel with a choke coil 20 and a spirally wound flat work coil 19 in series with capacitor 18 and tuned to a predetermined inaudible frequency. As will be described below, the thyristors are gated successively into conduction. With power switch 12 being turned on, thyristor 21 is assumed to have gated on, the commutating capacitor 18 will be charged to the instantaneous value of the source voltage. The charge stored on the capacitor 18 will be commutated through the subsequently gated-on thyristor 22 and through capacitor 17 to reversely bias the capacitor 18, thus completing a cycle of oscillation. To sustain the oscillations, the thyristors 21 and 22 are gated in succession at a frequency in the neighborhood of the resonant frequency of the commutating circuit. An inductive load placed over the work coil 19 will be heated by induction and the amount of heat generated in the work load is proportional to the gating frequency and to the period of time during which the oscillation current is passing through the work coil.

Figure 5:
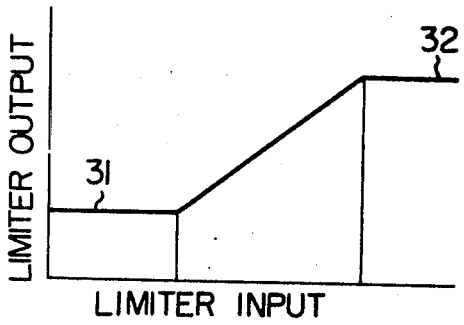
FIG. 5 is a graphic illustration of an input-output characteristic of a limiter of the embodiment of FIG. 1.

In order to provide a wide range of power control from 50 watts to 2 kilowatts, there is provided a power level setting circuit 23 schematically shown as comprising a potentiometer with its wiper terminal connected to an input terminal of a differential amplifier 24 to the other input of which is applied a signal which is representative of the power delivered from the work coil 19 to the inductive load with which the coil is electromagnetically coupled. This signal is derived from a rectifier 25 connected to the secondary winding of the transformer 15. The current induced in the transformer secondary is rectified into a DC voltage signal representing the power delivered to the load. The differential amplifier 24 provides an output corresponding to the difference between the two input voltages and feeds it to a limiter 26. This limiter has a linear amplification characteristic in a specified range as shown in FIG. 5 as a function of the input signal and provides a constant voltage outside of the specified range so that when the input voltage is lower than the lower limit the limiter output remains at a specified constant lower level 31 and when the input voltage is higher than the higher setting limit the output level remains at a specified higher constant level 32.

To the output of the limiter 26 is connected a voltage-controlled oscillator 27 which varies its output frequency linearly from 19 kHz to 25 kHz in response to the variation of the limiter output from the specified lower to higher voltage levels. The output from the oscillator 27 is passed through a gate 28 to a ring counter 29 which distributes the input pulse to its output leads 29*a* and 29*b*, which are connected to the control electrodes of the thyristors 21, 22, respectively.

Figure 6:
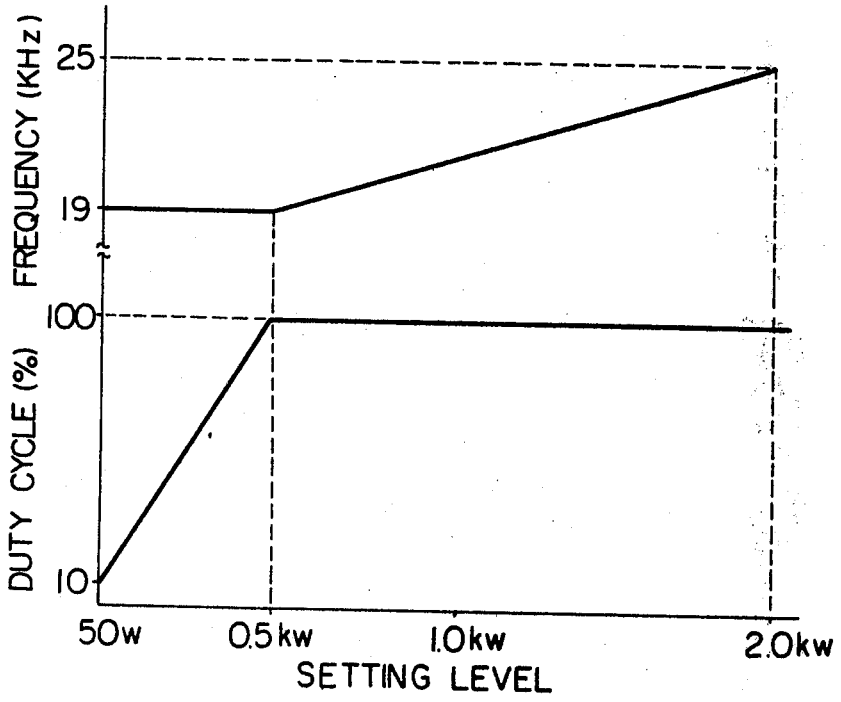
FIG. 6 is a graphic illustration of the control range of frequencies and duty cycles in relation to setting power level.

As illustrated in FIG. 6, the power control by the change in gating frequency begins at a power setting level which corresponds to 0.5 kilowatts and continues until a point corresponding to 2.0 kilowatts is reached. For the power setting range from 50 watts to 0.5 kilowatts, the gating frequency is made constant by the limiting function of the limiter 26. The lower frequency level is set by the upper audible frequency limit and the higher frequency level is determined by the operating characteristic of the thyristors. If the generated frequency is lower than 19 kHz noise will be generated in the audible frequency range.

The controllable power range is extended to the 50-watt level by a duty-cycle control circuit as indicated by broken-line block 33 which includes a zero crossover detector 34, a ramp generator 35, a comparator 36 and a D flip-flop 37. The zero crossover detector 34 senses a zero voltage point of the source voltage through leads 38 and 39 and provides an output pulse when the source voltage reaches zero to the clock terminal of the flip-flop 37.

The ramp generator 35 is designed to generate a train of sawtooth wave pulses at a frequency lower than the frequency of the source voltage, for example, 10 Hz. The output from the ramp generator 35 is applied to the inverting input of comparator 36 for comparison with the power setting level on its noninverting input received from the setting circuit 23. The comparator 36 will be switched to a low voltage level when the instantaneous value of the sawtooth wave is above the reference level. The amplitude of the sawtooth wave is selected to correspond to the 0.5-kilowatt power level, so that when the power setting level falls below the 0.5-kilowatt level, the portion of the sawtooth wave exceeding the setting level increases with the decrease in the setting level, and the duration of the low voltage level at the comparator output consequently increases.

The D flip-flop 37 has its data input terminal D connected to the output of comparator 36 so that its Q output changes its binary state to the binary state of the data input when the clock input receives an output from the detector 34, the Q output being connected to the control terminal of the gate 28.

Figure 2:
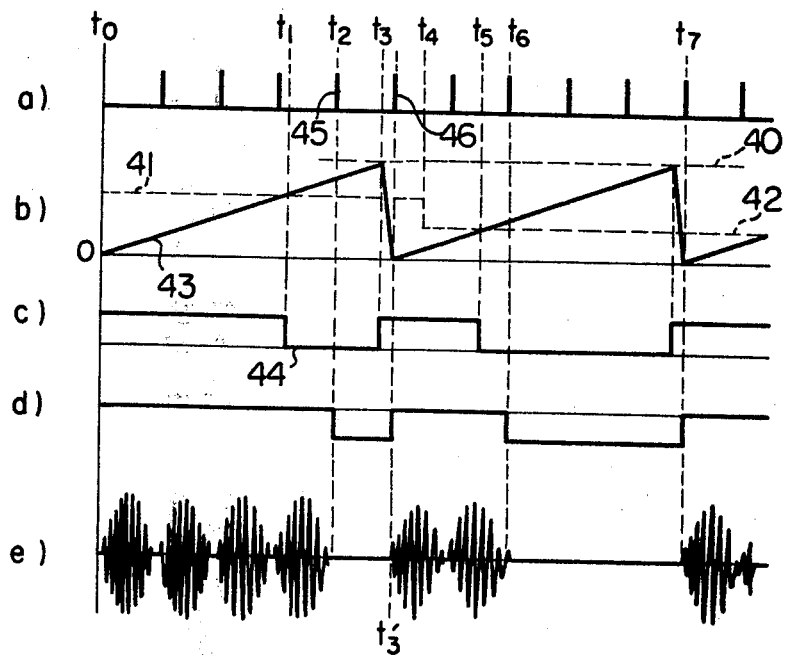
FIG. 2 is a timing diagram useful for describing the operation of the embodiment of FIG. 1.

The operation of the duty-cycle control circuit 33 will be best understood by reference to the timing diagram shown in FIG. 2. A series of pulses shown in FIG. 2*a* is the output from the zero crossover detector 34 which appears at a rate of 120 pulses per second if the source voltage frequency is assumed to be 60 Hz. During time interval from $t_0$ to $t_4$, the power is assumed to be set at a level 41 and during time interval from $t_4$ onward, the setting level is assumed to change to a lower level 42. The first setting level 41 is lower than the 0.5-killowatt level which corresponds to a level indicated by broken lines 40 so that during time interval $t_1$ to $t_3$ a sawtooth wave pulse 43 (FIG. 2*b*) exceeds the setting level 41 resulting in a low-level output pulse 44 from the comparator 36 (FIG. 2*c*). Therefore, during the interval $t_1$ to $t_3$, the binary state of the data input terminal of flip-flop 37 is the low-voltage level or "0" logic state. At time $t_2$ an output 45 from the zero crossover detector 34 triggers the flip-flop 37 so that its Q output changes to the binary state of the data input, i.e., the "0" state which is maintained until time $t_3'$ when the next output 46 from zero crossover detector 34 occurs subsequent to time $t_3$. Therefore, during the time interval $t_0$ to $t_2$, the Q output of flip-flop 37 is high and the gate 28 is enabled to pass the oscillations (FIG. 2*e*) to the ring counter 28 and during the time interval $t_2$ to $t_3'$, gate 28 is disabled and no power is delivered.

By lowering the power setting level to the level 42, the gate 28 is disabled for a period $t_6$ to $t_7$ which is three times longer than the period of the previous setting.

By the manual adjustment of the setting level the duty cycle can be reduced to as low as 10% to give a minimum power of 50 watts. The extended range of power level to such low level is particularly advantageous for cooking operations where foodstuff is simmered, or stewed gently with a bubbling sound below or just at the boiling point.

It is noted that the high frequency oscillation is disabled from a given zero crosspoint of the source voltage to a subsequent zero crosspoint so that the thyristors are re-fired at low source voltage. This is advantageous for eliminating surge current which might occur when the thyristors are fired suddenly with a high source voltage.

Figure 3:
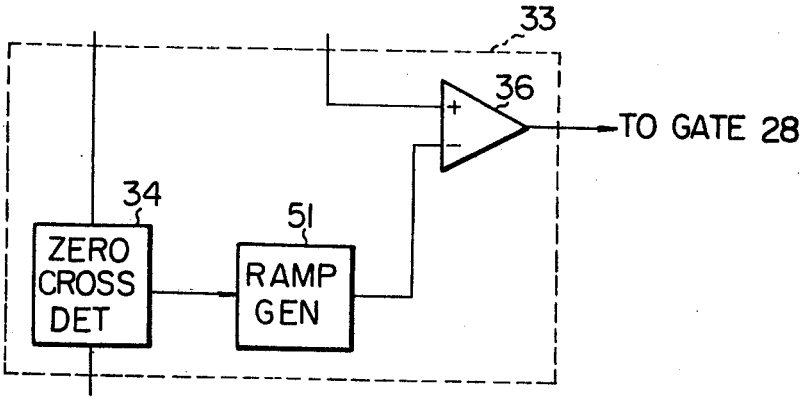
FIG. 3 is a modification of a duty-cycle control circuit of the embodiment of FIG. 1.
Figure 4:
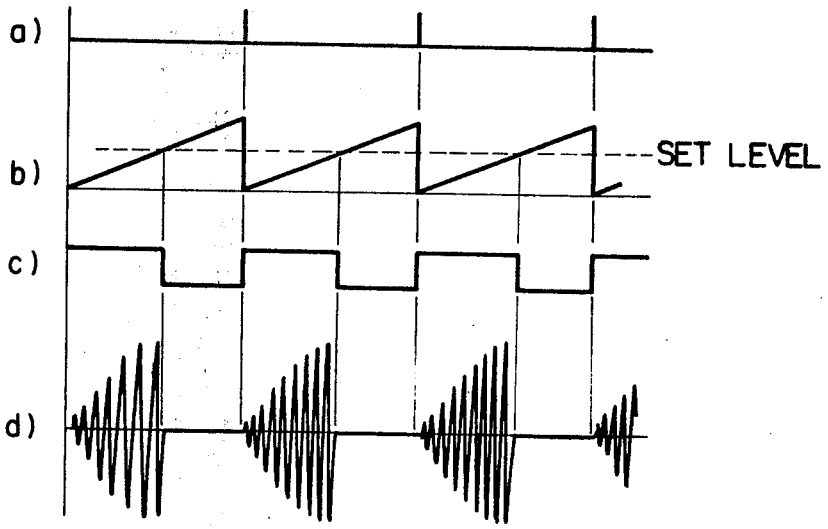
FIG. 4 is a timing diagram useful for describing the operation of the circuit of FIG. 3.

FIG. 3 illustrates a modification of the duty-cycle control circuit 33. In this modification, a ramp generator 51 is connected to the output of zero crossover detector 34 to generate a train of sawtooth waves in synchronism with each zero crosspoint of the source voltage as shown in FIGS. 4*a* and 4*b*. The output of the ramp generator 51 is connected to the inverting input of comparator 36 for comparison with the setting level, the output of the comparator 36 being directly connected to the control terminal of the gate 28.

In operation, the comparator 36 generates a train of low-level pulses (FIG. 4*c*) with a duration inversely proportional to the power setting level. While the comparator 36 is switched to the low output state, the gate 28 is disabled to suspend oscillations as illustrated in FIG. 4*d*. Since the sawtooth wave is synchronized with the zero voltage point of the voltage source, the thyristors are re-fired in synchronism with a detected zero crosspoint.

Since the detected power is returned for comparison with the setting power level, the frequency and hence the power delivered to the load is controlled to the desired level regardless of the size of the load. For example, if a relatively small inductive load is heated, there may be a substantial difference between the setting level and the actual power delivered to the load so that a correcting signal will be generated from the differential amplifier 24 that compensates for the difference by reducing the frequency of the voltage-controlled oscillator until the output from the differential amplifier 24 settles on a steady state value. This steady state value is the desired power level for the particular inductive load and the frequency is automatically controlled in response to the size of the load.

What is claimed is:

1. Induction heating cooking apparatus comprising: a solid state switching device, a commutating circuit including a work coil in circuit with said solid state switching device to receive power from a source of low frequency alternating energy, means for setting a desired power level, means for triggering said switching device at a high frequency in a preselected range in accordance with the setting of said desired power level when the setting power is within a higher range of power levels to thereby generate high frequency energy in said commutating circuit, and means for disabling said high frequency energy for periodic time intervals in accordance with the setting of said desired power level when said setting power is within a lower range of power levels.

2. Induction heating cooking apparatus as claimed in claim 1, wherein said triggering means comprises:

means for detecting an electrical quantity representative of power delivered to an inductive load electromagnetically coupled with said work coil;

means for generating a signal representative of the difference between said detected power and said setting power level;

a voltage-controlled oscillator responsive to said difference representative signal for generating high frequency energy; and means for limiting the magnitude of said difference representative signal so that the output from said voltage-controlled oscillator varies within a range from the inaudible frequency limit to a frequency which corresponds to the turnoff time of said switching device.

3. Induction heating cooking apparatus as claimed in claim 2, wherein said disabling means comprises:

means for detecting a zero crosspoint of said low frequency energy;

means for generating a train of sawtooth pulses at a frequency equal to or lower than the frequency of said low frequency energy, the maximum amplitude of said sawtooth wave pulses being selected at a value corresponding to said power setting level at which said high frequency energy is at the inaudible frequency limit; and means for generating a disabling signal when the amplitude of said sawtooth wave pulses is above said power setting level.

4. Induction heating cooking apparatus as claimed in claim 3, wherein said sawtooth wave pulses are generated at a frequency lower than the frequency of said low frequency energy, and said disabling pulse generating means comprises a comparator for providing comparison in amplitude between the sawtooth wave pulses and said power setting level, and a D flip-flop having a data input terminal connected to the output of said comparator and a clock input terminal connected to the output from said zero crosspoint detecting means, whereby the output from said D flip-flop is a signal corresponding to said disabling signal.

5. Induction heating cooking apparatus as claimed in claim 3, wherein said sawtooth wave pulses are generated in response to the output from said zero crosspoint detecting means, and said disabling pulse generating means comprises a comparator for providing comparison in amplitude between said sawtooth wave pulses and said setting level.

* * * * *